US006079878A

United States Patent [19]

Yeager

[11] Patent Number: 6,079,878

[45] **Date of Patent: *Jun. 27, 2000**

[54] RECLOSABLE BAG WITH PROFILE STRIP FASTENER ASSEMBLY, AND BAG BODY

[76] Inventor: James W. Yeager, 505 Cumberland Rd. East, Mobile, Ala. 36608

[ * ] Notice: This patent is subject to a terminal disclaimer.

[21] Appl. No.: 08/827,826

[22] Filed: Apr. 11, 1997

[51] Int. Cl.[7] ..... B65D 33/24

[52] U.S. Cl. ..... 383/203; 383/61; 383/63; 383/66; 383/210

[58] Field of Search ..... 383/200, 204, 383/203, 205, 207, 210, 211, 61, 63, 66

[56] References Cited

U.S. PATENT DOCUMENTS

| | | | |
|---|---|---|---|
| 2,978,769 | 4/1961 | Harrah . | |
| 3,172,443 | 3/1965 | Ausnit . | |
| 3,181,583 | 5/1965 | Lingenfelter . | |
| 3,426,959 | 2/1969 | Lemelson . | |
| 3,532,571 | 10/1970 | Ausnit . | |
| 3,608,439 | 9/1971 | Ausnit . | |
| 3,619,395 | 11/1971 | Skendzic | 383/205 X |
| 3,827,472 | 8/1974 | Uramoto . | |
| 3,948,705 | 4/1976 | Ausnit . | |
| 4,335,817 | 6/1982 | Bahr . | |
| 4,570,820 | 2/1986 | Murphy . | |
| 4,617,683 | 10/1986 | Christoff . | |
| 4,655,862 | 4/1987 | Christoff et al. . | |
| 4,782,951 | 11/1988 | Griesbach et al. . | |
| 4,807,964 | 2/1989 | Sare | 385/143 |
| 4,894,975 | 1/1990 | Ausnit . | |
| 4,935,089 | 6/1990 | Schirmer | 156/272.6 |
| 5,002,781 | 3/1991 | Van Erden | 383/63 X |
| 5,022,530 | 6/1991 | Zieke . | |
| 5,024,537 | 6/1991 | Tilman . | |
| 5,026,563 | 6/1991 | Van Erden et al. | 383/63 X |
| 5,036,643 | 8/1991 | Bodolay | 383/61 X |
| 5,036,645 | 8/1991 | Schwarz | 383/63 X |
| 5,063,069 | 11/1991 | Van Erden et al. . | |
| 5,096,516 | 3/1992 | McDonald et al. . | |
| 5,116,140 | 5/1992 | Hirashima . | |
| 5,128,183 | 7/1992 | Buzio | 428/35.7 |
| 5,167,608 | 12/1992 | Steffens, Jr. et al. | 383/66 X |
| 5,186,543 | 2/1993 | Cochran . | |
| 5,221,144 | 6/1993 | Schwarz et al. | 383/63 |
| 5,358,334 | 10/1994 | Simonsen | 383/61 X |
| 5,425,825 | 6/1995 | Raslo et al. | 383/211 X |
| 5,461,845 | 10/1995 | Yeager . | |
| 5,601,368 | 2/1997 | Bodolay et al. . | |
| 5,672,009 | 9/1997 | Malin | 383/63 X |

FOREIGN PATENT DOCUMENTS

| | | | |
|---|---|---|---|
| 682604 | 12/1966 | Belgium | 383/207 |
| 0 528 721 A2 | 2/1993 | European Pat. Off. . | |

*Primary Examiner*—Stephen P. Garbe
*Assistant Examiner*—Robin A. Hylton
*Attorney, Agent, or Firm*—Rockey, Milnamow & Katz, Ltd.

[57] ABSTRACT

A package in the form of a reclosable bag includes a bag body including front and back walls, and a profile strip fastener assembly sealingly mounted on the inside surface of the front wall. The profile strip fastener assembly includes a pair of releasably interlocking profile strips, with a secondary, peelable seal provided between the profile strips apart from their mechanically interlocked portions. By this arrangement, enhanced sealing for the package is provided, while abating the stress to which the interlocked portions of the profile strips are subjected during forming and filling of the package. The bag body preferably includes a frangible joint substantially aligned with the fastener assembly for gaining access to the assembly, with the frangible joint desirably providing tamper-evidence of opening of the package. The profile strips are sealed to the front wall of the bag body with a continuous oval shaped seal around the frangible joint. The perimeter seal is located above the peelable seal.

9 Claims, 2 Drawing Sheets

RECLOSABLE BAG WITH PROFILE STRIP FASTENER ASSEMBLY, AND BAG BODY

TECHNICAL FIELD

The present invention relates generally to flexible bag-like packages, and more particularly to a flexible reclosable bag package including an improved sealing arrangement for a profile strip fastener assembly mounted on a front wall of the body of the bag.

BACKGROUND OF THE INVENTION

Reclosable packaging is particularly suited for packaging of food products when it is desired to repeatedly remove relatively small quantities of the food product. Such food products include cereals, rice, candies, and the like, and may also include meat food products, such as chicken, frankfurters, sliced meats, etc. While the use of reclosable flexible bags having twist-tie wire fasteners or plastic clasps has long been known, recent advents in reclosable packaging have included configuring packages to have integral zipper-type fastener assemblies, including interlocking profile strips. In such arrangements, the package is typically opened by cutting or tearing a portion of the package to gain access to the fastener assembly, with opening and closing of the profile strips of the fastener assembly thereafter permitting the package to be selectively opened and closed.

While packages having integrated profile strip fastener assemblies are becoming common in the marketplace, heretofore, such arrangements have typically require specialized packaging machinery for forming and filling such packages. Significantly, U.S. Pat. No. 5,461,845 discloses a reclosable package, and method of formation, which is specifically configured to facilitate use on conventional, so-called form, fill, and seal machinery. This type of machinery forms and fills packages with food product (or other articles) by forming a package from a web of plastic material or the like, and substantially simultaneously filling and sealing the package. The package disclosed in the above-referenced patent includes a profile strip fastener assembly which is configured such that a plurality of fastener assemblies can be provided on a substantially continuous web of package-forming material, with the web then stored in rolled or fan-folded form prior to use. The web of packaging material can then be supplied to a conventional form, fill, and seal machine, with the machine operated in a generally conventional manner to package the product as desired. By the provision of the profile strip fastener assembly in the front wall portion of the package, convenient reclosability of the package is provided without resort to twist-tie fasteners, plastic clasps, or the like. The above-referenced patent is hereby incorporated by reference.

The present invention contemplates a reclosable package in the form of a bag which is configured for use with conventional form, fill and seal machinery, while providing enhanced sealed integrity for the package as well as tamper-evidence of opening.

SUMMARY OF THE INVENTION

A package in the form of a reclosable bag embodying the principles of the present invention includes a profile strip fastener assembly which is joined to a front wall of a bag body in a manner which permits formation of the bag in web form prior to use with a conventional form, fill and seal machine. Notably, the profile strip fastener assembly includes a peelable seal, in addition to the closure formed by the interlocking profile strips of the assembly, thus enhancing the sealing integrity of the fastener assembly during package formation, filling, and subsequent storage and use. An arrangement for securing the profile strip fastener assembly to the front wall of the bag body can be desirably configured to effect hermetic (i.e., substantially air-tight) sealing of an associated perforated region of the front wall which provides access to the contents of the package. Oxygen barrier packaging can be produced in accordance with the principles disclosed herein by the provision of profile strip assemblies and bag film materials exhibiting oxygen-barrier properties.

In accordance with the illustrated embodiment, the present reclosable bag includes a bag body formed from a rectangular sheet of film material, such as plastic film material or the like. The bag body has a top end, a bottom end, a front wall, and a back wall, wherein the front wall is joined to the back wall by upper and lower seams respectively provided at the top and bottom ends of the bag body.

A reclosable profile strip fastener assembly is joined to the front wall of the bag body and comprises first and second interlocking profile strips which respectively extend along the length of the fastener assembly. The profile strips are configured for releasable interlocking engagement with each other by the provision of at least one elongated protuberance on one of the profile strips, and at least one groove defined by the other of the profile strips for respectively releasably receiving the protuberance.

The fastener assembly is specifically configured for independent securement to the inside surface of the front wall of the bag body, and to this end, the first profile strip of the assembly includes a body flange portion joined to an inside surface of the front wall. Similarly, the second profile strip includes another body flange portion joined to the inside surface of the front wall of the bag body.

In order to enhance the sealing integrity of the fastener assembly, and to better carry loads to which the assembly is subjected during formation, filling, shipment, and storage of the package, one of the profile strips of the fastener assembly includes a seal flange portion, with the assembly including a seal formed between the seal flange portion of the one profile strip, and the body flange portion of the other one of the profile strips. In this manner, the seal must be opened to provide access to the opening between the first and second profile strips when they are released from interlocking engagement with each other.

In the preferred embodiment, the front wall of the bag body includes an elongated, frangibly openable joint which is substantially aligned with the fastener assembly. This openable joint provides access to the seal and interlocking profile strips of the fastener assembly after the joint is opened on the front wall of the bag body. The provision of this openable joint in the bag body desirably provides tamper-evidence of opening of the bag. The first and second profile strips are sealed to the front wall with a continuous seal which closely surrounds the joint, and which can be configured to effectively hermetic seal the perforation which preferably defines the joint. The second profile strip can also be sealed along its bottom edge region to the bag front wall.

Providing the surrounding seal in close proximity to the joint creates a secure and hermetically sealed bag. A reduced sealing region is required. The second profile strip is held more securely to the front wall which facilitates reclosing of the bag using the profile strips. Also, the second profile strip is closed at its top end to the front wall, preventing trapping of small particles behind the second profile strip.

Other features and advantages of the present invention will become readily apparent from the following detailed description, the accompanying drawings, and the appended.

DETAILED DESCRIPTION

Figure 1:
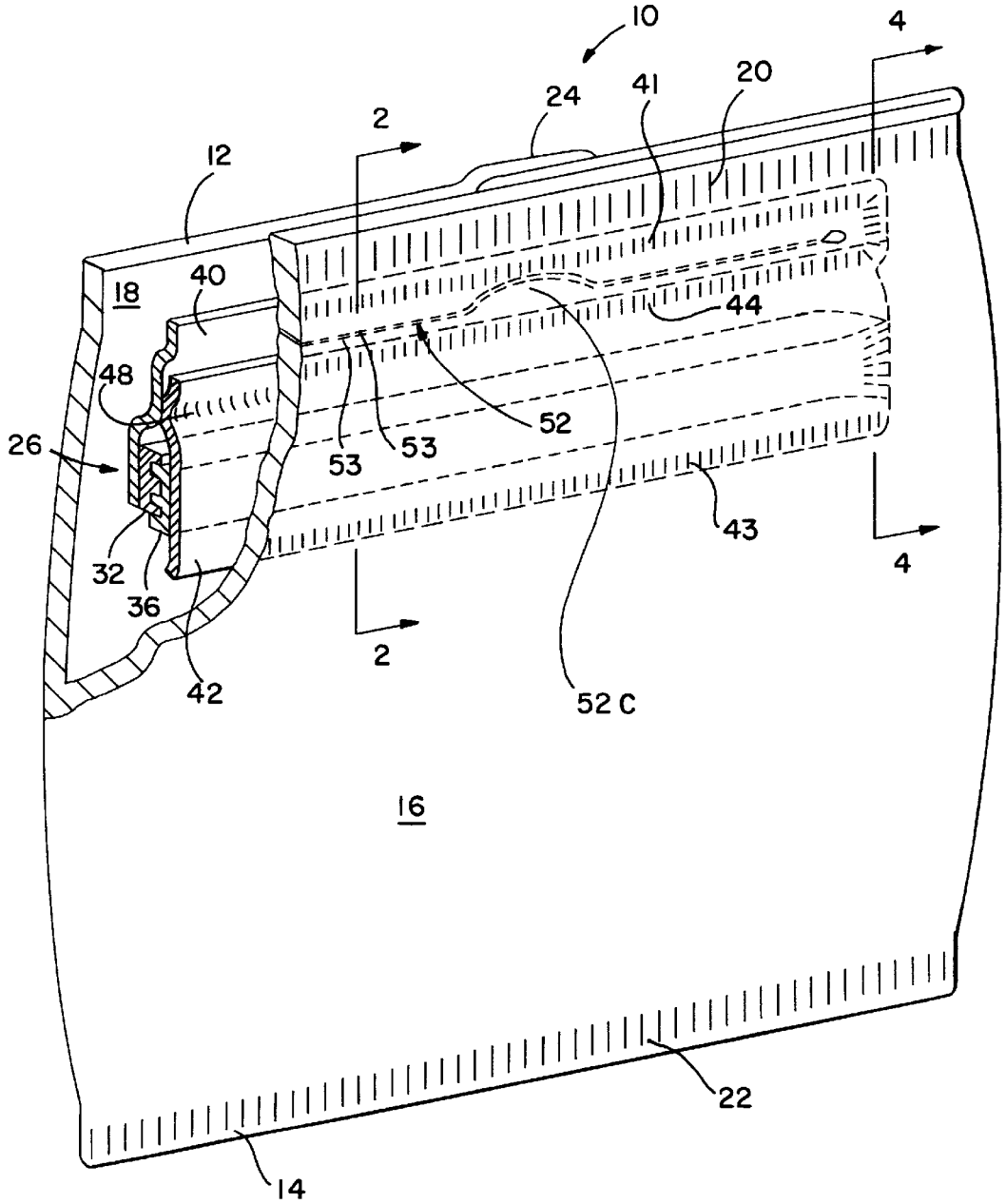
FIG. 1 is a perspective partially cut-away view of a package in the form of a reclosable bag embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiments illustrated.

With reference now to the drawings, therein is illustrated a package in the form of a reclosable bag 10 embodying the principles of the present invention. It is contemplated that the bag 10 be formed from suitable plastic film materials or the like, but it is within the purview of the present invention to form the bag from paper or paper-like materials. As will hereinafter be described, bag 10 is specifically configured in a manner which facilitates formation of the bag from a substantially continuous web of film material, to which fastener assemblies have been previously applied, for use in a so-called form, fill, and seal apparatus for packaging of food products, or non-food products. For example, the present package can be configured for packaging of non-food items such as hardware articles or the like, wherein repeated opening and closing of the package is desired.

The reclosable bag 10 is formed from a generally rectangular sheet of film material, and includes a top end generally designated 12, a bottom end generally designated 14, and front and back walls 16 and 18. The front and back walls are joined to each other by upper and lower seams 20, 22, respectively provided at top and bottom ends 12 and 14 of the bag. Lateral edges of the rectangular sheet of film material from which the bag body is formed are joined to each other along a back seam 24 extending vertically along back wall 18. The seams 20, 22, and 24 can be formed adhesively, or by heat-sealing as is known in the art. As will be appreciated, a bag configured in accordance with the present invention can be formed from two rectangular sheets of bag material joined at their peripheral regions to form a package, with the fastener assembly having a length corresponding to the width of the sheet of bag material to which the fastener assembly is joined.

Reclosable bag 10 includes profile strip fastener assembly 26 which is sealingly mounted on the inside surface of front wall 16. In order to permit use of the present bag with conventional packaging equipment, fastener assembly 26 has a length no more than one-half the width of the rectangular sheet of film material from which the bag body is formed. In practice, a substantially continuous sheet of film material is provided with a plurality of the fastener assemblies 26 mounted thereon at spaced locations, which spacing corresponds to the length dimension of the bags ultimately to be formed. For use, this web of film material (with the fastener assemblies mounted thereon) is supplied to a form, fill, and seal apparatus which operates to form a series of the bags 10, in end-to-end relationship, by formation of back seam 24, bottom seam 22, and top seam 20, as food product is supplied to the individual bags being formed. After formation and filling, the individual bags are ordinarily separated from each other for packaging and shipment, as may be required.

Figure 2:
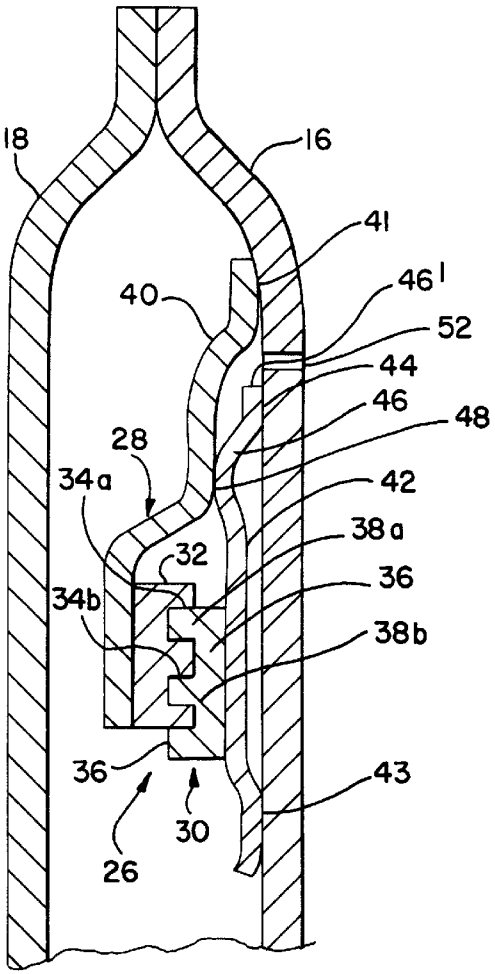
FIG. 2 is a fragmentary cross-sectional view taken along lines 2—2 of FIG. 1.

With particular reference to FIG. 2, the fastener assembly 26 includes a first elongated profile strip 28, and a second elongated profile strip 30 which are configured for releasable interlocking engagement with each other. While the specific configuration of the profile strips can be varied while keeping with the principles disclosed herein, it is contemplated that one of the profile strips (first strip 28 in the illustrated embodiment) includes a body 32 which defines at least one elongated groove, such as two grooves 34*a*, 34*b*, while the other profile strip (second strip 30) includes a body 36 which defines at least one protuberance, such as two protuberances 38*a*, 38*b*, configured for respective interlocking engagement with the grooves 34*a*, 34*b*. As will be recognized by those familiar with the art, the number of grooves and protuberances, and their respective disposition on the first and second profile strips, can be varied while keeping with the principles disclosed herein.

The fastener assembly 26 is sealingly mounted on the inside surface of the front wall 16 of the body of the reclosable bag 10, and to this end, each of the profile strips 28, 30, includes an elongated flange portion joined to the inside surface of the front wall. Specifically, first profile strip 28 includes a body flange portion 40 which is joined to the inside surface of front wall 16 by elongated seal region 41. Similarly, second profile strip 30 includes a body flange portion 42 (including upper and lower flange regions which respectively extend upwardly and downwardly from the body 36) which is joined to the inside surface of front wall 16 by lower elongated seal region 43 and upper elongated seal region 44. Elongated seal regions 41,44 may be arranged in the form of an continuous oval seal including end seal regions 50 described below. It is within the purview of the present invention that seal regions 41, 43, 44 may be formed with the use of suitable adhesive, but are preferably provided by heat-sealing (sometimes referred to as "lock-up" or "destruct" sealing). The seals 41, 43, 44 are preferably continuous for strength and for sealing of the contents of the bags, but discontinuous seals may be suitable for some applications.

The flange portions of the first and second profile strips 28, 30 may be unitary with the respective body of the profile strip by formation of the flange portion from the same piece of material as the respective body. As disclosed herein, it is within the purview of the present invention that at least one of the flange portions of the profile strips be formed from material which differs from that from which the respective body of the profile strip is formed. The configuration of the present package can be desirable for use with certain perishable products that must be packaged in a manner which limits the amount of oxygen to which the products are exposed. For packaging of such products, the bodies 32, 36 of the first and second profile strips can be separately manufactured, and the flange portions 40, 42, thereafter respectively attached to the bodies. The bodies of the profile strips are normally produced from low pressure polyethylene due to the close tolerances required for the desired interlocking relationship of the components, and for ease of manufacturing. In contrast, the flange portions of the profile strips can be formed from material which is substantially different from low pressure polyethylene for relatively low oxygen transmission, such as materials including nylon, EVOH (ethylene vinyl alcohol), or the like.

Figure 4:
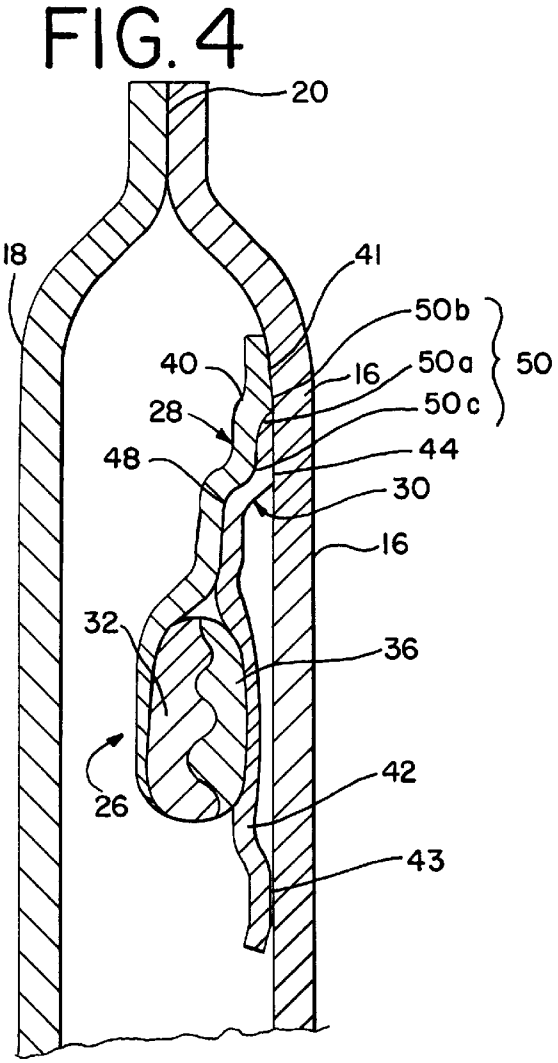
FIG. 4 is a fragmentary cross-sectional view taken along lines 4—4 of FIG. 1.

As will be observed in FIG. 2, it is presently preferred that the body flange portion 40 of first profile strip 28 be positioned in substantially flush and coextensive relationship with that surface of the body 32 which defines the groove 34*a*, 36*b*. In this preferred arrangement, as shown in FIG. 4, sealing of the ends of the profile strips to each other is preferably effected to facilitate handling of the strips prior to securement to the associated film material of the bag body. The nature of the profile strips 28, 30 is such that the interlocking portions of the strips can be configured to provide desirably high load-carrying characteristics, while at the same time still being readily manually detached from each other. However, in order to desirably reduce the stress to which the interlocked profile strips are subjected during bag formation and filling, and subsequent handling, the fastener assembly embodying the principles of the present invention includes a secondary, peelable seal which detachably joins the profile strips to each other, apart from the releasable engagement of protuberances 38*a*, 38*b* in the grooves 34*a*, 34*b*.

In the illustrated embodiment, this secondary securement is provided by the provision of a seal flange portion 46 extending upwardly from the body flange portion 42 of second profile strip 30, with a peelable seal 48 provided between the flange portion 46 and the body flange portion 40 of first profile strip 28. In the preferred form, the peelable seal 48 is provided in spaced relationship to an edge 46' of flange portion 46. Peelable seals such as seal 48 are configured to peel open easily using minimal opening forces by utilizing low sealing temperatures, reduced dwell times, and light sealing pressures. Peelable seals can also be produced by utilizing a single polymer or from a combination of polymers that molecularly produce low seal strengths. A peel seal can also be formed by selectively treating one or both of the flange portions of the profile strips, at least in the region at which the peel seal is to be formed (such as by the localized application or coating of adhesive or like material). This aspect of the present invention provides desired versatility, since it is contemplated that the peelable seal will be formed on the same side of the flange portion 40 which is secured to the inside surface of the associated bag body by seal 41. While seal 48 can be pre-formed as part of the fastener assembly 26 prior to its securement to the web or during its securement to the web from which bag 10 is formed, it may be desirable for some applications to form seal 48 at the time of filling of the bag.

As will be appreciated, the seal 48 preferably is configured to extend substantially the entire length of the fastener assembly 26, thus desirably acting to provide an additional seal for the contents of the bag 10 in addition to the seal provided by interlocked portions 34*a*, 34*b*, 38*a*, 38*b* of the profile strips 28, 30. Further sealing of the contents of the bag against air and moisture transmission is preferably effected by the provision of end seals 50 at respective opposite lateral ends of the fastener assembly 26.

End seals 50, as illustrated in FIG. 4, desirably act to sealingly join respective upper portions of lateral opposite ends of body flanges 40, 42 of the profile strips 28, 30 to each other at the interface 50*a*. As will be recognized, the end seals 50 can be formed to also seal portions of the opposite lateral ends of the body flange portion 40 along the interface 50*b* to the inside surface of the front wall 16, and to seal portions of the opposite lateral ends of the body flange portion 42 along the interface 50*c* to the inside surface of the front wall 16. The peelable seal 48 acts with the end seals 50 to substantially completely seal the region of the reclosable bag at which the fastener assembly 26 is provided (this can be desirable when the body of the bag is perforated to provide access to fastener assembly 26, as described below). The three sealing interfaces 50*a*, 50*b*, 50*c* are generally located within each end seal 50 as shown in FIG. 1.

Additionally, as shown in FIG. 4, at the lateral opposite ends of the fastener assembly, the fastener bodies 32,36 are flattened and sealed together to prevent slippage of the profile strips 26, 28, thus avoiding any potential misalignment when reclosing the fastener assembly.

Figure 3:
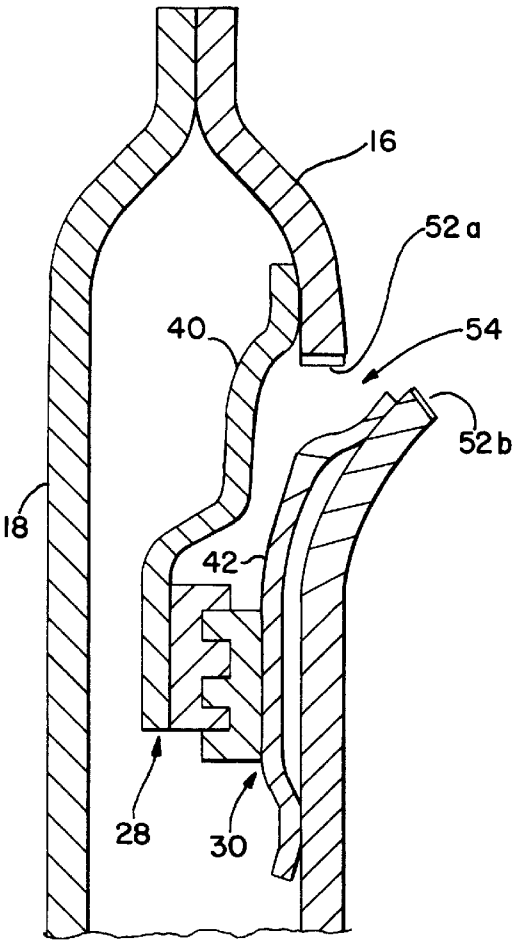
FIG. 3 is a fragmentary cross-sectional view of the reclosable bag of FIG. 2 but in an opening stage 1.

As illustrated in FIGS. 1 and 3, access to the fastener assembly 26 from the exterior of the package is preferably provided by the provision of an elongated, frangible region, substantially aligned with fastener assembly 26, and in particular in the region between edge 46' and seal 41. In the illustrated embodiment the frangible region comprises an elongated frangible joint 52 formed through the front wall 16 of the bag body.

The joint 52 is preferably defined by a preferentially weakened frangible portion of the bag front wall 16, such as by perforations 53, resulting in formation of an elongated opening 54 by which access to fastener assembly 26 is provided as illustrated in FIG. 3. The frangible joint separates into free ends 52*a*, 52*b*. As shown in FIG. 1, the joint has an arcuate center region 52*c* which, when separated, forms a convenient tab for handling by the user to pull apart the opening 54. Opening of the joint 52 permits peelable seal 48 to be readily opened. After separation and opening of seal 48, profile strips 28, 30 can be easily separated by disengagement of protuberances 38*a*, 38*b* from grooves 34*a*, 34*b*, thus permitting access to the contents of the package.

The seal region 44, as shown, is located above the peelable seal 48 and the protuberances 38*a*, 38*b*, and the grooves 34*a*, 34*b*. However, it will be appreciated that seals 44 and 48 can be aligned with each other by simultaneous formation of the two seals. The seal regions 41, 44 are continuous with the end seal regions 50 to form a continuous oval seal.

By providing the seal regions 41, 44 closely surrounding the frangible joint 52, a large and rigidifying seal can be avoided and only a thin surrounding seal can be used. Since seal regions 41, 44 are positioned on the same side of the profile strips (i.e., above the strips in the illustrated embodiment) a hermetic seal can be formed about the access opening (provided by joint 52) without the need to hermetically seal the bodies of the profile strips to each other and to the inside surface of the bag body. Additionally, due to the fact that the seal region 44 is located on the edge of the body flange 42, and the seal region 41 is located along an opposite lateral edge of the body flange 42, the profile strip 30 is more stably supported across its vertical dimension as shown in FIG. 2. Particles, such as particles from the bag contents, cannot become trapped between the body flange 42 and the front wall 16 of the bag body. The body flange is held in place for accurate engagement of the two strips 28,30.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover by the appended claims all such modifications as fall within the scope of the claims.

What is claimed is:

1. A reclosable bag comprising:

a bag body formed from at least one rectangular sheet of film material, said bag body having:

a top end, a bottom end, a front wall, and a back wall, said front wall being joined to said back wall by upper and lower seams respectively provided at said top and bottom ends; and a reclosable fastener assembly joined to said front wall and comprising first and second interlocking profile strips respectively extending along the length of the fastener assembly, said profile strips being configured for releasable interlocking engagement with each other by the provision of at least one protuberance on one of said profile strips, and at least one groove defined by the other of said profile strips for respectively releasably receiving said protuberance, said first profile strip including a body flange portion joined at a first seal to said front wall of said bag body and said second profile strip including another body flange portion joined at a second seal to said front wall of said bag body, said second seal formed along an edge of said second profile strip, said first seal located above said second seal;

an elongated frangible joint in said front wall aligned with said fastener assembly for providing access to said fastener assembly after opening of said joint;

a pair of end seals sealingly joining respective laterally opposite ends of said body flange portions and said first and second seals, so that said end seals and said first and second seals surround said elongated frangible joint;

one of said first and second profile strips including a seal flange portion, said fastener assembly including a peelable seal formed between and joining said seal flange portion of said one profile strip and the other one of said profile strips, said peelable seal located between said second seal and said protuberance, said bag body being formed from a single sheet of film material, with lateral edges of said rectangular sheet of film material from which said bag body is formed joined to each other along a back seam extending along said back wall, said fastener assembly having a length no more than one-half the width of said rectangular sheet of film material.

2. The reclosable bag body according to claim 1, wherein said body flange portion of at least one of said profile strips is unitary with the respective body of the profile strip by formation from the same piece of material.

3. The reclosable bag body according to claim 1, wherein said body flange portion of at least one of said profile strips is formed from different material than the respective body of the profile strip.

4. The reclosable bag body according to claim 1, wherein at least one of said profile strips is joined to said front wall by adhesive.

5. A reclosable bag in accordance with claim 1, wherein said seal flange portion of said one profile strip is joined by said peelable seal to the body flange portion of the other one of said profile strips.

6. A reclosable bag in accordance with claim 1, including a pair of end seals at respective opposite ends of said fastener assembly for joining respective ends of said profile strips to each other.

7. The bag body according to claim 1, wherein said flange portions being formed from material which exhibits relatively low oxygen transmission.

8. The bag body according to claim 1, wherein said material from which said flange portion is formed is selected from the group consisting of nylon and ethylene vinyl alcohol.

9. The bag body according to claim 1, wherein each of said profile strips comprises a body, said flange portion of at least one of said profile strips being formed from different material than the respective body of the profile strip.

* * * * *